US008668308B2

(12) United States Patent
Snyder et al.

(10) Patent No.: US 8,668,308 B2
(45) Date of Patent: Mar. 11, 2014

(54) INKJET EJECTOR ARRAYS ALIGNED TO A CURVED IMAGE RECEIVING SURFACE WITH INK RECIRCULATION

(75) Inventors: Trevor Snyder, Newberg, OR (US); Brent Rodney Jones, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/614,025

(22) Filed: Sep. 13, 2012

(65) Prior Publication Data

US 2013/0002763 A1 Jan. 3, 2013

Related U.S. Application Data

(63) Continuation of application No. 12/948,926, filed on Nov. 18, 2010, now Pat. No. 8,317,298.

(51) Int. Cl.
*B41J 2/145* (2006.01)

(52) U.S. Cl.
USPC ..... 347/40; 347/42; 347/44; 347/49; 347/102; 347/104; 430/320

(58) Field of Classification Search
None
See application file for complete search history.

(56) References Cited

U.S. PATENT DOCUMENTS

| | | | |
|---|---|---|---|
| 5,598,196 | A | 1/1997 | Braun |
| 6,234,605 | B1 | 5/2001 | Hilton |
| 6,386,684 | B1 | 5/2002 | Brennan et al. |
| 7,623,144 | B2 | 11/2009 | Fotland et al. |
| 7,690,779 | B2 | 4/2010 | Spehrley, Jr. et al. |
| 8,118,405 | B2 | 2/2012 | Xie et al. |
| 2005/0151768 | A1 | 7/2005 | Merz et al. |
| 2006/0127817 | A1 | 6/2006 | Ramanujan et al. |
| 2007/0206051 | A1 | 9/2007 | Silverbrook |
| 2010/0149270 | A1 | 6/2010 | Silverbrook |
| 2011/0109707 | A1 | 5/2011 | Murray |
| 2011/0228024 | A1 | 9/2011 | Lang et al. |

*Primary Examiner* — Matthew Luu
*Assistant Examiner* — John P Zimmermann
(74) *Attorney, Agent, or Firm* — Maginot, Moore & Beck, LLP

(57) ABSTRACT

A printhead assembly includes a plurality of inkjet ejector arrays having corresponding ink receptacles. Each inkjet array is formed from a plurality of inkjet stack layers that are bonded to a single aperture layer that flexes to position the inkjet arrays at a predetermined distance from a curved image receiving surface.

19 Claims, 6 Drawing Sheets

INKJET EJECTOR ARRAYS ALIGNED TO A CURVED IMAGE RECEIVING SURFACE WITH INK RECIRCULATION

CLAIM OF PRIORITY

This document claims priority to co-pending U.S. patent application Ser. No. 12/948,926, which was filed on Nov. 18, 2010 and is entitled "Inkjet Ejector Arrays Aligned To A Curved Image Receiving Surface With Ink Recirculation." The co-pending application issued as U.S. Pat. No. 8,317,298 on Nov. 27, 2012.

TECHNICAL FIELD

This disclosure relates generally to inkjet printing systems, and more particularly, to the printheads used in such systems.

BACKGROUND

Solid inkjet printing systems are well known. These printing systems include an ink loader, a melting device, at least one printhead, a media transport path, a rotating image receiving member, a release agent application system, a transfix roller, and a media receptacle. Solid ink in various forms, such as sticks, pellets, and pastilles, are inserted into one or more feed channels, each of which terminates in a melting device. The melting device heats the solid ink to a phase change temperature at which the solid ink melts and becomes liquid ink. The liquid ink is supplied to a printhead. A printhead controller generates firing signals that correspond to image data to operate the printhead(s), which eject the melted ink onto a liquid layer supported by a rotating image receiving member to form an ink image on the image receiving member. Media are retrieved from a media supply in the system and transported along the media transport path to a nip selectively formed between the transfix roller and the rotating image receiving member. The arrival of the media is synchronized with the arrival of the ink image on the image receiving member at the nip. The pressure in the nip helps transfer and fix the ink image from the image receiving member to the media. The media then continues along the media transport path to the media receptacle where the media bearing the image may be collected.

At various times during operation, the printheads may be pressurized to purge ink through the inkjet ejectors instead of ejecting the ink as drops directed to the image receiving member. Capturing the purged ink for recirculation is advantageous. Imaging devices having curved image receiving members, however, present challenges to printhead assemblies that recapture purged ink. Multi-color imaging devices, for example, collect and recirculate each color of ink separately to maintain the integrity of the ink colors for re-use. Inserting ink recapture structures between the printheads may increase the length of the printheads in a process direction and, consequently, increase the separation of the printheads from one another. As the zone in which the printheads are arranged gets longer in the process direction, orienting the printheads so they conform to the curvature of the image receiving member becomes increasingly difficult. Thus, the alignment of multiple printheads with respect to the curvature of an image receiving member and efficient collection of purged ink are important aspects in inkjet printers.

SUMMARY

In at least one embodiment, an improved printing apparatus enables printhead alignment about a curved image receiving member. The printing apparatus includes a first plurality of inkjet stack layers having a first array of inkjet ejectors, a second plurality of inkjet stack layers having a second array of inkjet ejectors, an aperture layer having a first array of apertures and a second array of apertures that are separated from one another by a predetermined distance, the aperture layer being bonded to the first plurality of inkjet stack layers to enable the first array of inkjet ejectors to eject ink through the first array of apertures and to the second plurality of inkjet stack layers to enable the second array of inkjet ejectors to eject ink through the second array of apertures and to enable the first array of inkjet ejectors and the second array of inkjet ejectors to be positioned with a predetermined alignment about a curved surface.

In another embodiment, an improved printing apparatus facilitates positioned of multiple inkjet ejector arrays about a rotating image receiving member. The printing apparatus includes a plurality of inkjet stack layers having a first array of inkjet ejectors and a second array of inkjet ejector, and an aperture layer having a first array of apertures and a second array of apertures that are separated from one another by a predetermined distance, the aperture layer being bonded to the first plurality of inkjet stack layers to enable the first array of inkjet ejectors to eject ink through the first array of apertures and to the second plurality of inkjet stack layers to enable the second array of inkjet ejectors to eject ink through the second array of apertures and to enable the first array of inkjet ejectors and the second array of inkjet ejectors to be positioned with a predetermined alignment about a curved surface.

DETAILED DESCRIPTION

Figure 1:
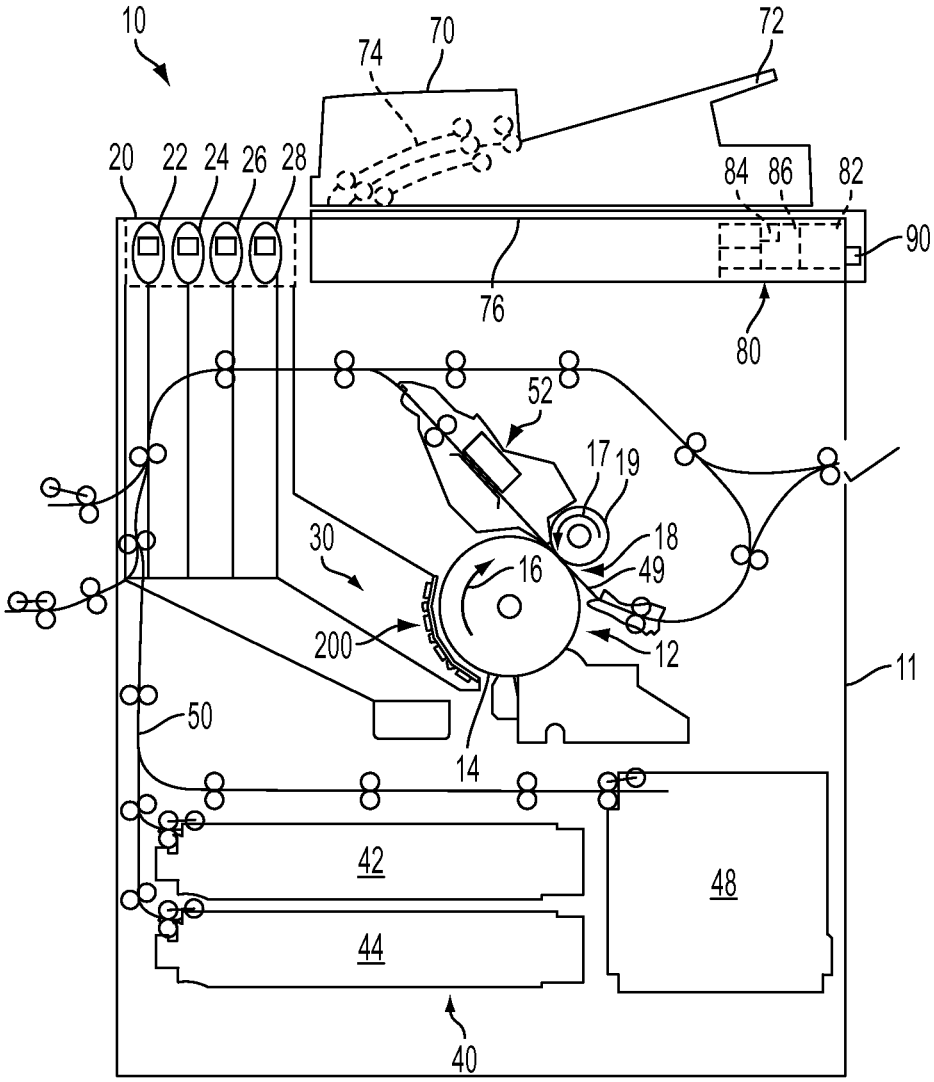
FIG. 1 is a schematic view of a phase-change ink printer including an articulated printhead assembly aligned with a curved image receiving member.

For a general understanding of the environment for the system and method disclosed herein as well as the details for the system and method, reference is made to the drawings. In the drawings, like reference numerals have been used throughout to designate like elements. As used herein the term "printer" refers to any device that is configured to eject a marking agent upon an image receiving member and include photocopiers, facsimile machines, multifunction devices, as well as direct and indirect inkjet printers that are configured to use phase-change, aqueous, solvent-based, or UV curable inks and the like. As used herein, "purging ink" refers to any emission of ink from an inkjet ejector that does not land on an image receiving member whether deliberate or accidental. Purged ink refers to ink emitted from the ejector during purging. As used herein, the terms "joint" refers to any feature formed between two segments of a planar assembly that is configured to bend, flex, deform, or rotate to enable the two segments to move with respect to one another about the joint. Joints formed between planar assemblies having a plurality layers may also enable segments of some of the plurality of layers to separate from each other when the segments are moved about the joint. As used herein, the term "articulated" refers to a shape formed from two or more segments of a planar assembly that are bent relative to one another along one or more joints. As used herein, the term "process" direction refers to a direction of travel of an image receiving member, such as an imaging drum or print medium, and the term "cross-process" direction is a direction that is perpendicular to the process direction along the surface of the image receiving member.

FIG. 1 depicts an embodiment of a printer 10 that includes an articulated printhead assembly 200. As illustrated, the printer 10 includes a frame 11 to which is mounted directly or indirectly all its operating subsystems and components, as described below. The phase change ink printer 10 includes an imaging member 12 that is shown in the form of an imaging drum, but can equally be in the form of a supported endless belt. The imaging drum 12 has an image receiving surface 14 that is movable in the direction 16, and on which phase change ink images are formed. A transfix roller 19 rotatable in the direction 17 is loaded against the surface 14 of drum 12 to form a transfix nip 18, within which ink images formed on the surface 14 are transfixed onto a heated media sheet 49, which may be heated prior to traveling through the nip.

The phase change ink printer 10 also includes a phase change ink delivery subsystem 20 that has at least one source 22 of one color phase change ink in solid form. Since the phase change ink printer 10 is a multicolor printer, the ink delivery system 20 includes four (4) sources 22, 24, 26, 28, representing four (4) different colors CMYK (cyan, magenta, yellow, black) of phase change inks. The phase change ink delivery system also includes a melting apparatus (not shown) for melting or phase changing the solid form of the phase change ink into a liquid form. The phase change ink delivery system is suitable for supplying the liquid ink to a printhead system 30 that includes an articulated printhead assembly 200. Printhead assemblies similar to assembly 200 include at least two ink receptacles, ink manifolds, and inkjet ejector arrays.

Figure 2:
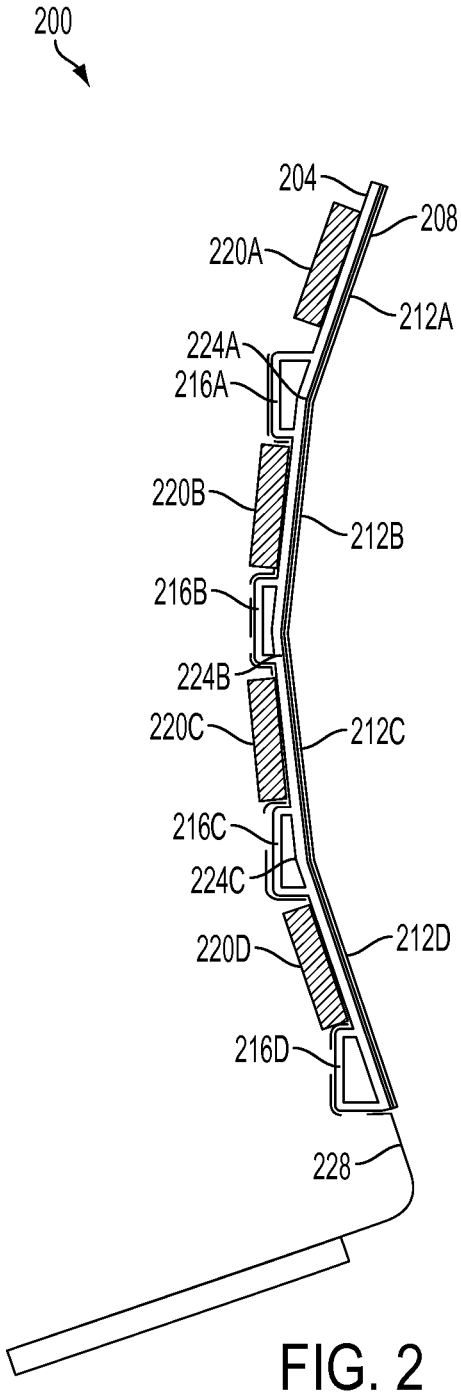
FIG. 2 is a cross-sectional view of an articulated printhead assembly.

FIG. 2 depicts a more detailed view of printhead assembly 200 having four ink receptacles 216A-216D, ink manifolds 220A-220D and inkjet ejector arrays 212A-212D, respectively. With reference to FIG. 1 and FIG. 2, each ink manifold 220A-220D receives melted ink from one of the ink sources 22, 24, 26, and 28, and supplies the melted ink to only one of the printhead arrays 212A-212D, respectively. To simplify FIG. 1 fluid connections from ink sources to manifolds 220A-220D are not shown. Each ink receptacle 216A-216D is positioned below a corresponding array of inkjet ejectors 212A-212D, respectively, to receive ink flowing down the face of one of the inkjet ejector arrays during purge operations. Each of the ink receptacles 216A-216D captures ink of a single color from the corresponding array of inkjet ejectors 212A-212D immediately above each receptacle. As explained in more detail below, a slot is positioned proximate to each inkjet ejector array to enable ink flowing down an ejector array face to enter the receptacle. The articulated printhead assembly 200 enables each of the inkjet ejector arrays 212A-212D to have a substantially uniform distance from the curved surface 14 of image receiving drum 12. Thus, each array of inkjet ejectors in printhead assembly 200 is aligned along a radius extending from the center of imaging drum 12. Printhead assembly 200 is oriented with respect to the center of image receiving drum 12 to enable gravity to urge ink purged ink flowing out of each of inkjet ejector arrays 212A-212D into a corresponding ink one of ink receptacles 216A-216D.

As further shown, the phase change ink printer 10 includes a substrate supply and handling system 40. The substrate supply and handling system 40, for example, may include sheet or substrate supply sources 42, 44, 48, of which supply source 48, for example, is a high capacity paper supply or feeder for storing and supplying image receiving substrates in the form of cut sheets 49, for example. The substrate supply and handling system 40 also includes a substrate handling and treatment system 50 that has a substrate heater or pre-heater assembly 52. The phase change ink printer 10 as shown may also include an original document feeder 70 that has a document holding tray 72, document sheet feeding and retrieval devices 74, and a document exposure and scanning system 76.

In the example of FIG. 1, operation and control of the various subsystems, components and functions of printer 10 are performed with the aid of a controller or electronic subsystem (ESS) 80. The ESS or controller 80 may be a self-contained, dedicated mini-computer having a central processor unit (CPU) 82 with electronic storage 84, and a display or user interface (UI) 86. In addition, the CPU 82 reads, captures, prepares and manages the image data flow between image input sources, such as the scanning system 76, or an online or a work station connection 90, and the articulated printhead assembly 200. As shown in FIG. 1, the ESS or controller 80 is the main multi-tasking processor for operating and controlling all of the other printing subsystems and functions, including operation of the articulated printhead assembly 200 discussed below. Alternative printer embodiments may include one or more electronic control devices configured to operate various printing subsystems including one or more printhead assemblies.

In operation, image data for an image to be produced are sent to the controller 80 from either the scanning system 76 or via the online or work station connection 90 for processing and output to the articulated printhead assembly 200. Additionally, the controller 80 determines and/or accepts related subsystem and component controls, for example, from operator inputs via the user interface 86, and accordingly executes such controls. As a result, appropriate color solid forms of phase change ink are melted and delivered to printhead assembly 200. The controller operates the printheads to eject ink onto a layer of release agent on the imaging surface 14 to form ink images corresponding to the image data. Image receiving substrates are supplied by any one of the sources 42, 44, 48 and directed by the substrate system 50 to the nip formed between image receiving member 14 and the transfix roller 19 in timed registration with the ink image formed on the surface 14. As the ink image and media travel through the nip, the ink image is transferred from the surface 14 and fixedly fused to the image substrate within the transfix nip 18.

Figure 3:
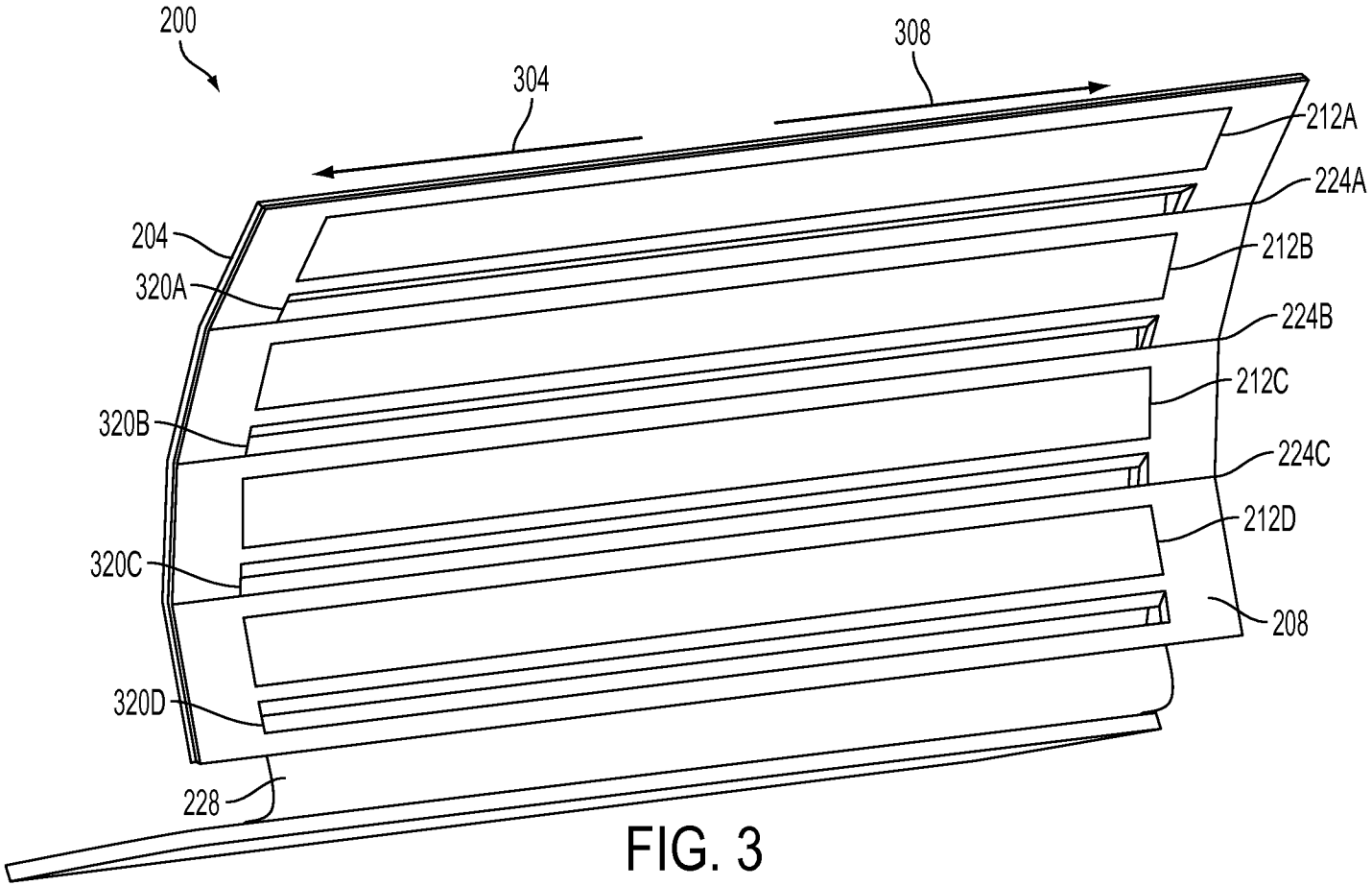
FIG. 3 is a frontal view of the articulated printhead assembly of FIG. 2.

FIG. 2 and FIG. 3 depict an articulated printhead assembly 200 suitable for use in an imaging device, such as printer 10. FIG. 2 shows a cross-sectional view of an articulated printhead assembly 200. The articulated printhead assembly 200 includes a plurality of inkjet stack layers 204, aperture layer 208, inkjet ejector arrays 212A-212D, ink receptacles 216A-216D, ink manifolds 220A-220D, and a flexible circuit 228. FIG. 3 shows a front view of the printhead assembly 200, and additionally shows slots 320A-320D. In the embodiment of FIG. 2 and FIG. 3, inkjet ejector arrays 212A-212D have a width in the cross-process direction, shown by arrows 304 and 308, that is substantially the full width of the image receiving member, although alternative embodiments may have inkjet ejector arrays with varying widths or multiple spaced slots. Ink manifolds 220A-220D each hold a supply of melted ink received from one of a plurality of ink sources, such as ink sources 22-28 seen in FIG. 1. Each inkjet ejector array 212A-212D includes a plurality of inkjet ejectors configured to receive melted ink from one of the ink manifolds 220A-220D, respectively. In the example embodiment of printhead assembly 200, inkjet ejector arrays 212A-212D are configured to eject inks having cyan, magenta, yellow, and black colors, respectively, although alternative embodiments may use different ink colors, greater or fewer colors of ink, and arrange ink colors in a different order than seen in printhead assembly 200.

The plurality of inkjet stack layers 204 include layers formed from various materials that may include, but are not limited to, metal layers, silicon, and polymer layers that include transducers, diaphragms, various fluid cavities, and conduits. Each array of inkjet ejectors 212A-212D includes a plurality of inkjet ejectors formed from the plurality of inkjet stack layers 204. These ejectors are typically arranged in a predetermined pattern across the face of each inkjet ejector arrays 212A-212D, as shown in FIG. 3. Various types of inkjet ejectors may be used in the inkjet ejector arrays and may include piezo or acoustic ejectors, thermal ejectors, electrostatic ejectors, and the like that are formed in the inkjet stack layers 204. Aperture layer 208 includes a plurality of aperture nozzle arrays that correspond to the inkjet ejectors for each of the inkjet ejectors arrays 212A-212D. The nozzles enable the inkjet ejectors to eject ink drops toward an image receiving surface. Flexible circuit 228 includes a plurality of electrical leads operatively connected to the inkjet ejectors and to a controller (not shown). During an imaging operation, the controller generates electrical firing signals and one or more inkjet ejectors eject ink drops toward an image receiving surface in response to the firing signals activating the inkjet ejectors.

Figure 4:
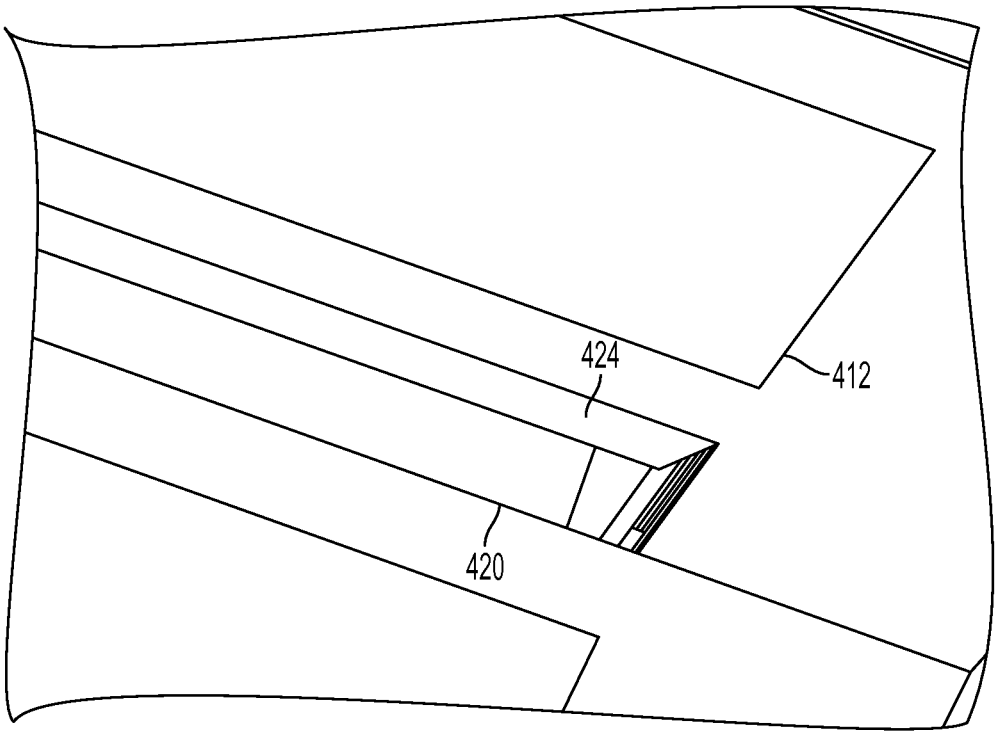
FIG. 4 is a frontal view of a slot for receiving purged ink.

During a purge operation, at least one of the inkjet ejector arrays 212A-212D is pressurized to urge ink through the inkjet ejectors and out of the nozzles so the purged ink flows down the face of the aperture layer 208. Slots 320A-320D are positioned proximate to inkjet ejector arrays 212A-212D to enable purged ink from each inkjet ejector array 212A-212D to enter one of receptacles 216A-216D, respectively. Slots 320A-320D are formed through all of the inkjet stack layers 204 and aperture layer 208. The slots 320A-320D occupy positions that enable purged ink to enter a corresponding receptacle 216A-216D while preventing inks having different colors from mixing during a purge operation. FIG. 4 depicts a single slot 420 configured to receive purged ink from an inkjet array 412. A beveled wall 424 of the slot 420 extends along the width of the inkjet ejector array 412. In this example, the shape of beveled wall 424 forms an angle with respect to the surface of ejector array 412 of less than 90° to promote a flow of purged ink through the slot 420. Various methods that may be used to produce beveled wall 424 include forming the beveled shape through progressive cutting and forming dies, or folding a portion of the aperture layer 208 into the slot 420. Alternative configurations for the slots may include slots having walls that are perpendicular to the surface of the ejector array 412 or walls that have a curved shape. Alternative methods of forming the slots include forming the slots in each layer of the inkjet stack individually, or cutting the slots after the inkjet stack layers have been bonded together.

As purged ink flows down the inkjet arrays 212A-212D, gravity and surface tension between the purged ink and the aperture layer 208 urge the purged ink through corresponding slots 320A-320D. In some embodiments, a negative pressure source may also apply a negative pressure through the slots 320A-320D to draw ink into the receptacles 216A-216D during purge operations. Each of the receptacles 216A-216D is in further fluid communication with an ink source or ink manifold holding a supply of ink having the same color as the ink collected in the respective receptacle. Ink in each of the receptacles 216A-216D may be recirculated to the ink source or manifold for use in imaging operations. The recirculation process may remove air bubbles and contaminants that may be present in the purged ink.

The materials used in forming the plurality of inkjet stack layers 204 may include some layers that are rigid and brittle, while the aperture layer 208 may be formed from one or more layers of flexible materials, such as metals or polymers. The inkjet stack layers 204 include joints, such as joints 224A-224C, that are formed between ejector arrays 212A-212D. These joints 224A-224C are formed across each layer of the plurality of inkjet stack layers 204 in the cross-process direction during the manufacturing process. These joints are configured to have a breaking strength strong enough to enable formation of the inkjet stack layers 204 and bonding of the inkjet stack layers 204 to aperture layer 208 without breaking or flexing. After the bonding process is complete, each of the joints 224A-224C sufficiently bends in response to a flexing force applied to the aperture layer 208 that the joint separates to enable the articulated shape of printhead assembly 200 to be formed. Aperture layer 208, however, is not formed with such a joint so the aperture layer remains intact and bends in accordance with the articulated shape. As seen in FIG. 3, ejectors arrays 212A-212D are positioned a predetermined distance from one another on the plurality of inkjet stack layers 204 and aperture layer 208. The frangible joints 224A-224C are positioned between adjacent inkjet ejector arrays in the plurality of inkjet ejector arrays 212A-212D with sufficient space between each joint and the surrounding inkjet ejector arrays to enable flexing or breaking of each joint without damaging the inkjet ejector arrays 212A-212D.

During formation of the inkjet stack layers 204, inkjet ejectors in the ejector arrays 212A-212D are aligned with one another in the cross-process direction so that corresponding inkjet ejectors in each of the ejector arrays eject ink drops that land in proximity to one another in the cross-process direction on the image receiving member during imaging operations. Appropriate cross-process alignment enables registration of ink drops of a selected number of colors, such as CMYK inks, to produce images with various colors formed from combinations of the ink drops. The aperture layer 208 maintains the cross-process alignment of the inkjet ejectors in ejector arrays 212A-212D after the joints 224A-224C flex to enable cross-process alignment in printhead assembly 200. Thus, the integrity of the aperture layer and the ability of the inkjet stack layers to bend with regard to the curvature of the image receiving surface preserve the registration of the ink drops generated by different inkjet ejector arrays after the positioning of the printhead assembly about the image receiving member in a manner that produces a consistent gap distance between the image receiving member and the aperture layer.

Figure 5A:
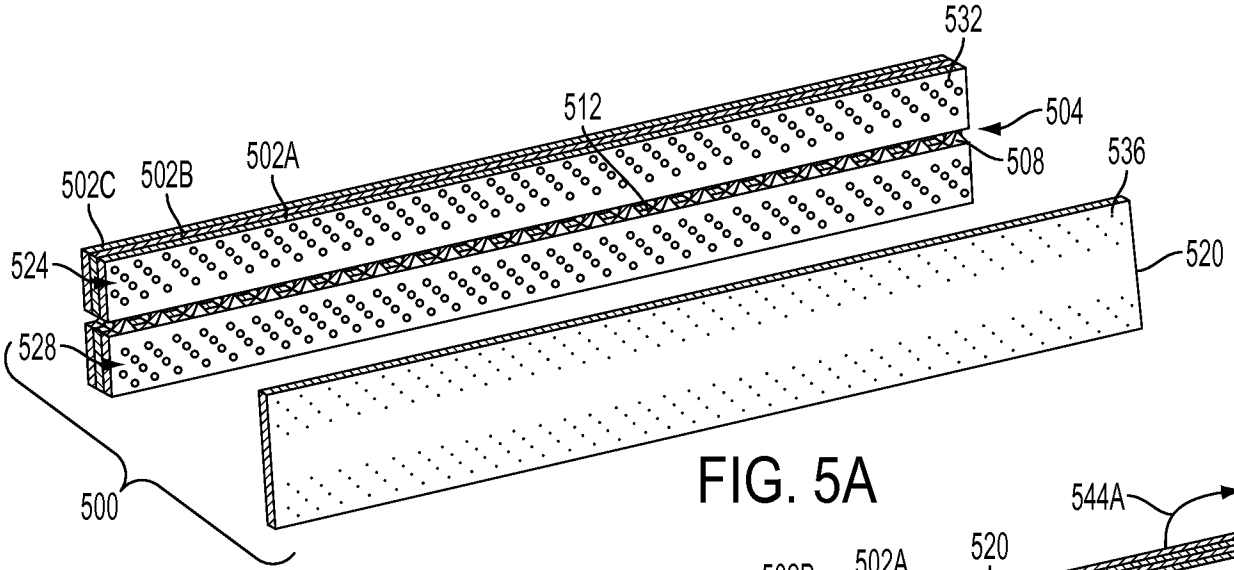
FIG. 5A is a partially exploded view of a joint positioned between two inkjet ejector arrays.
Figure 5B:
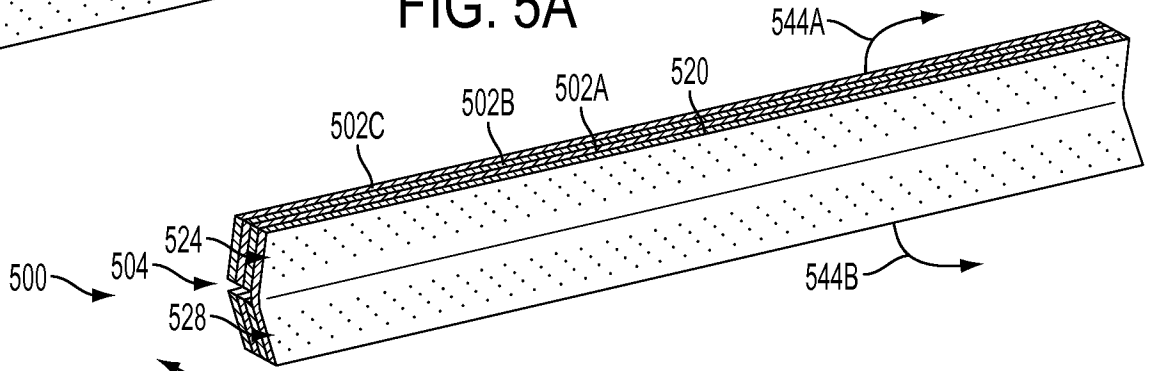
FIG. 5B is a view of the inkjet ejector arrays of FIG. 5A bonded to an aperture layer.

FIG. 5A shows a partially exploded view of a printhead assembly 500 including inkjet stack layers 502A-502C and aperture layer 520. The inkjet stack layers 502A-502C have been bonded together to form printhead arrays 524 and 528. The arrays 524 and 528 are separated by a joint 504. FIG. 5B shows the printhead assembly 500 with aperture plate 520 bonded to the inkjet stack layers 502A-502C. Inkjet stack layers 502A-502C form the exemplary inkjet stack with the exception of the aperture layer 520. The layers 502A-502C include various features such as transducers, diaphragms, fluid cavities, and conduits that form the inkjet ejector arrays 524 and 528. The three layers shown in FIG. 5A are only illustrative of an inkjet stack having multiple layers, and various inkjet stack embodiments may have different numbers of layers. In FIG. 5B, aperture plate 520 is shown bonded to inkjet stack layer 502A to enable inkjet ejector outlets, such as outlet 532, aligned with aperture nozzles in the aperture layer 520, such as nozzle 536, to eject or purge ink drops from ejector arrays 524 and 528. The inkjet ejector arrays 524 and 528 may receive and eject inks having different colors. Various other features, such as slots to receive purged ink, may also be formed through the inkjet stack layers 502A-502C and aperture layer 520. These features are omitted to simplify the drawings in FIG. 5A and FIG. 5B.

Joint 504 is shown formed through inkjet ejector stack layers 502A-502C positioned between the inkjet ejector arrays 524 and 528. The joint 504 is positioned with sufficient distance separating the joint 504 from the inkjet ejector arrays 524 and 528 to enable the inkjet stack layers 502A-502C to flex about joint 504 without damaging inkjet ejector arrays 524 and 528. Joint 504 includes a plurality of features, seen here as joining teeth 508, extending between the portion of each of layers 502A-502C containing inkjet array 528 and the portion containing inkjet array 524. Gaps, such as gap 512 formed between the joining teeth 508, reduce the tensile strength of each inkjet stack layer 502A-502C along the joint 504. The joining teeth 508 have a triangular shape with a base formed from the section of the inkjet stack layers 502A-502C containing printhead array 528 and a vertex that contacts the inkjet stack layers 502A-502C containing printhead array 524. Alternative forms of joining features may include any number or shape of deformable or frangible tabs or walls that extend from either or both sides of the joint.

The selected configuration of joining teeth 508 provides the joint 504 with sufficient strength to remain intact while forming and bonding the inkjet stack layers 502A-502C to the aperture layer 520. The strength of joint 504 is also weak enough to enable the joint 504 to bend or break in response to a flexing force applied to the aperture layer 520, and thus enable the inkjet ejector arrays 524 and 528 to move about the joint 504. Aperture layer 520 lacks the joint and joining teeth seen in joint 504. The aperture layer 520 is configured to flex and remain intact to form an articulated printhead assembly, and the inkjet stack layers 502A-502C remain bonded to the aperture layer 520. Aperture layer 520 may optionally include features that promote bending along the joint 504, while enabling the aperture layer 520 to remain intact after flexing.

As shown in FIG. 5B, in response to a flexing force applied to aperture layer 520 in direction 544, inkjet ejector array 524 moves in direction 544A and inkjet ejector array 528 moves in direction 544B about the joint 504. In some embodiments, the joining teeth 508 of joint 504 may break to separate the inkjet ejector arrays 524 and 528, while in other embodiments the joining teeth remain intact and bend in response to the flexing force. Aperture layer 520 flexes in directions 544A and 544B, and the inkjet stack layers 502A-502C remain bonded to aperture layer 520 to form an articulated printhead assembly. The degree of flex applied to aperture layer 520 is selected to form an articulated printhead assembly enabling the inkjet ejector arrays to be positioned with a predetermined alignment about a curved image receiving surface as shown in FIG. 1. Joint 504 reduces mechanical stresses placed on the inkjet ejector arrays 524 and 528 during flexing to avoid damage to the inkjet ejector arrays 524 and 528. Either prior to or after forming the articulated printhead assembly, additional printhead components including ink manifolds, ink receptacles, and electrical circuits may be attached to the inkjet stack layers 502A-502C and aperture layer 520.

Figure 6:
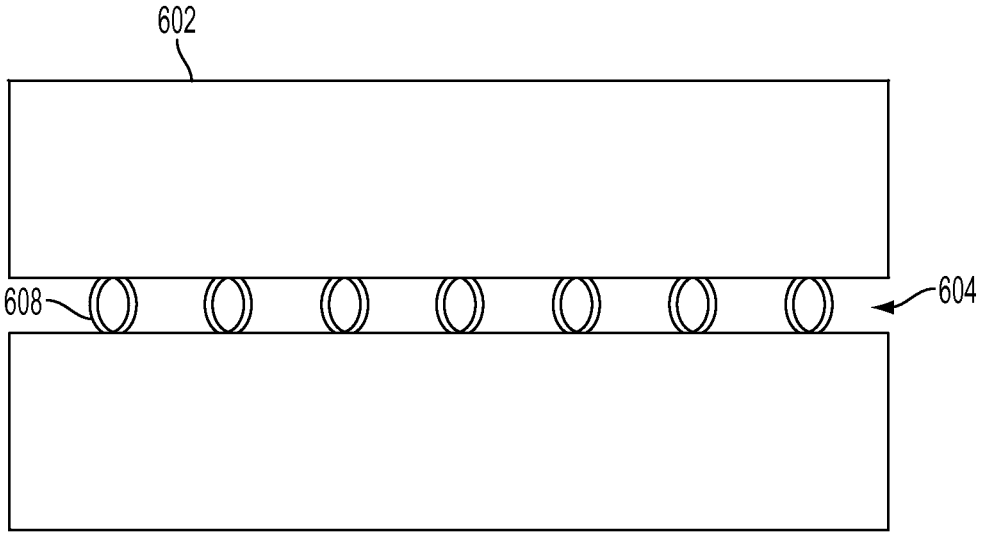
FIG. 6 is frontal view of a joint formed in an inkjet ejector stack layer.

Alternative joint embodiments are configured to bend in response to a flexing force while remaining intact. FIG. 6 depicts an exemplary inkjet stack layer 602 shown with a joint 604 and a plurality of deformable symmetrical legs 608 that extend through the joint 604. In the embodiment of FIG. 6, the symmetrical legs 608 bend and deform without breaking in response to a flexing force. The symmetrical legs 608 enable inkjet stack layer 602 to remain intact when flexed to an articulated position. In inkjet stack embodiments where one or more inkjet stack layers have deformable joints, some of the inkjet stack layers may be flexed into an articulated shape prior to bonding other inkjet stack layers or printhead components. For example, embodiments in which the inkjet stack layer includes deformable joints, the inkjet stack may be flexed into an articulated shape prior to bonding the aperture layer to the articulated inkjet stack.

It will be appreciated that variants of the above-disclosed and other features and functions, or alternatives thereof, may be desirably combined into many other different systems, applications or methods. For example, while the articulated inkjet assemblies depicted herein have four arrays for four ink colors, alternative embodiments may include fewer or greater inkjet ejector arrays configured to use ink of one or more colors. While printer 10 depicts a printing apparatus configured to use phase-change inks, alternative embodiments may use aqueous, solvent based, UV curable, or various other inks and marking agents. While an indirect printer is described, the foregoing printhead assemblies may also be used in direct marking printers. Various presently unforeseen or unanticipated alternatives, modifications, variations or improvements therein may be subsequently made by those skilled in the art which are also intended to be encompassed by the following claims.

What is claimed:

1. A printing apparatus comprising:

a first plurality of inkjet stack layers having a first array of inkjet ejectors, the first array of inkjet ejectors having a width in a cross-process direction and a length in a process direction;

a second plurality of inkjet stack layers having a second array of inkjet ejectors, the second array of inkjet ejectors having a width in the cross-process direction and a length in the process direction, and the second array of inkjet ejectors being displaced from the first array of inkjet ejectors in the process direction;

an aperture layer having a first array of apertures and a second array of apertures that are separated from one another in the process direction by a predetermined distance, the aperture layer being bonded to the first plurality of inkjet stack layers to enable the first array of inkjet ejectors to eject ink through the first array of apertures and to the second plurality of inkjet stack layers to enable the second array of inkjet ejectors to eject ink through the second array of apertures; and a joint formed between the first plurality of inkjet stack layers and the second plurality of inkjet stack layers, the joint extends in the cross-process direction to enable the first array of inkjet ejectors to move relative to the second array of inkjet ejectors in response to the aperture layer being flexed to enable the first array of inkjet ejectors and the second array of inkjet ejectors to be positioned with the predetermined alignment about a curved surface.

2. The printing apparatus of claim 1, the joint further comprising:

a plurality of joining teeth between each inkjet stack layer in the first plurality of inkjet stack layers and each inkjet stack layer in the second plurality of inkjet stack layers.

3. The printing apparatus of claim 2 wherein the joining teeth are triangular.

4. The printing apparatus of claim 2, the joint further comprising:

a plurality of legs between each inkjet stack layer in the first plurality of inkjet stack layers and each inkjet stack layer in the second plurality of inkjet stack layers, each leg in the plurality of legs being configured to deform in response to the aperture layer being flexed.

5. The printing apparatus of claim 1 further comprising:

a first slot formed in the aperture layer to extend in the cross-process direction between the first array of apertures and the second array of apertures, the first slot being positioned to enable ink purged from the first array of apertures to drain through the aperture layer before reaching the second array of apertures.

6. The printing apparatus of claim 5 further comprising:

a second slot formed in the aperture layer, the second slot being positioned to enable ink purged from the second array of apertures to drain through the aperture layer.

7. The printing apparatus of claim 1 wherein the predetermined alignment of the first array of inkjet stack ejectors and the second array of inkjet stack ejectors enables the first array of inkjet stack ejectors and the second array of inkjet stack ejectors to be aligned with a radius from a center of an imaging drum.

8. The printing apparatus of claim 5, the first plurality of inkjet stack layers further comprising:

a receptacle fluidly communicating with the first slot in the aperture layer to receive ink entering the first slot in the aperture layer.

9. The printing apparatus of claim 6, the second plurality of inkjet stack layers further comprising:

a receptacle fluidly communicating with the second slot in the aperture layer to receive ink entering the second slot in the aperture layer.

10. A printing apparatus comprising:

a plurality of inkjet stack layers having a first array of inkjet ejectors and a second array of inkjet ejectors, each of the first array and the second array having a width in a cross-process direction and a length in a process direction, and the second array of inkjet ejectors being displaced from the first array of inkjet ejectors in a process direction; and a single aperture layer having a first array of apertures and a second array of apertures that are separated from one another in the process direction by a predetermined distance, the aperture layer being bonded to the first plurality of inkjet stack layers to enable the first array of inkjet ejectors to eject ink through the first array of apertures and to the second plurality of inkjet stack layers to enable the second array of inkjet ejectors to eject ink through the second array of apertures, and to enable the first array of inkjet ejectors and the second array of inkjet ejectors to be positioned at a same distance from a curved surface.

11. The printing apparatus of claim 10 further comprising:

a joint formed between the first array of inkjet ejectors and the second array of inkjet ejectors, the joint extending in the cross-process direction to enable the first array of inkjet ejectors to move relative to the second array of inkjet ejectors in the process direction in response to the aperture layer being flexed to enable the first array of inkjet ejectors and the second array of inkjet ejectors to be positioned at the same distance from the curved surface.

12. The printing apparatus of claim 11, the joint further comprising:

a plurality of joining teeth in each inkjet stack layer in the plurality of inkjet stack layers, the plurality of joining teeth in each inkjet stack layer being formed in a region between the first array of inkjet ejectors and the second array of inkjet ejectors.

13. The printing apparatus of claim 12 wherein the joining teeth are triangular.

14. The printing apparatus of claim 11, the joint further comprising:

a plurality of legs between each inkjet stack layer in the first plurality of inkjet stack layers and each inkjet stack layer in the second plurality of inkjet stack layers, each leg in the plurality of legs being configured to deform in response to the aperture layer being flexed.

15. The printing apparatus of claim 10 further comprising:

a first slot formed in the aperture layer to extend in the cross-process direction between the first array of apertures and the second array of apertures, the first slot enabling ink purged from the first array of apertures to drain through the aperture layer.

16. The printing apparatus of claim 15 further comprising:

a second slot formed in the aperture layer, the second slot being positioned to enable ink purged from the second array of apertures to drain through the aperture layer.

17. The printing apparatus of claim 10, the curved surface further comprising:

an imaging drum onto which the first array of inkjet stack ejectors and the second array of inkjet stack ejectors eject ink as the imaging drum rotates in the process direction.

18. The printing apparatus of claim 15, the plurality of inkjet stack layers further comprising:

a receptacle fluidly communicating with the first slot in the aperture layer to receive ink entering the first slot in the aperture layer.

19. The printing apparatus of claim 18, the plurality of inkjet stack layers further comprising:

another receptacle fluidly communicating with the second slot in the aperture layer to receive ink entering the second slot in the aperture layer.

* * * * *